US006958442B2

(12) United States Patent
Moussa

(10) Patent No.: US 6,958,442 B2
(45) Date of Patent: Oct. 25, 2005

(54) DYNAMIC MICROTUNABLE MIDI INTERFACE PROCESS AND DEVICE

(75) Inventor: Ahmed Shawky Moussa, Tallahassee, FL (US)

(73) Assignee: Florida State University Research Foundation, Tallahassee, FL (US)

( * ) Notice: Subject to any disclaimer, the term of this patent is extended or adjusted under 35 U.S.C. 154(b) by 284 days.

(21) Appl. No.: 10/359,870

(22) Filed: Feb. 6, 2003

(65) Prior Publication Data

US 2003/0145714 A1 Aug. 7, 2003

Related U.S. Application Data

(60) Provisional application No. 60/358,688, filed on Feb. 7, 2002.

(51) Int. Cl.[7] ..... G10H 7/00

(52) U.S. Cl. ..... 84/645; 84/609; 84/619; 84/649; 84/657

(58) Field of Search ..... 84/600, 609, 615, 84/619, 649, 653, 657, 445, 447, 449, 451, 84/454–455, 645

(56) References Cited

U.S. PATENT DOCUMENTS

| | | | | |
|---|---|---|---|---|
| 5,412,153 A * | 5/1995 | Saito | ..... | 84/619 |
| 5,501,130 A * | 3/1996 | Gannon et al. | ..... | 84/454 |
| 5,949,012 A * | 9/1999 | Ishii | ..... | 84/615 |
| 6,087,578 A * | 7/2000 | Kay | ..... | 84/626 |
| 6,323,408 B1 * | 11/2001 | Liu | ..... | 84/451 |

* cited by examiner

*Primary Examiner*—Marlon Fletcher
(74) *Attorney, Agent, or Firm*—J. Wiley Horton

(57) ABSTRACT

A software solution to the pitch limitations inherent in the MIDI standard. The invention uses the Polyphonic Aftertouch (also known as "Key Aftertouch") messages available in the basic MIDI standard to retune selected notes, according to the following process: First, a standard note lying on the Western scale is played. Then, a Polyphonic Aftertouch signal is immediately sent to shift the pitch of the standard note to transform it into a non-standard note. The Polyphonic Aftertouch message follows immediately behind the Note On message and pitch value creating the standard note. Thus, the standard note only sounds for about 960 microseconds. The shortest temporal resolution of the human ear is approximately 2–3 milliseconds. As a result, the human ear does not hear the first standard note, since it does not sound for a sufficient length of time. The human ear only perceives the pitch shifted note.

6 Claims, 8 Drawing Sheets

| Scale Degree | Note | Frequency |
|---|---|---|
| 1 | C | 262 |
| 2 | C# | 277 |
| 3 | D | 294 |
| 4 | D# | 311 |
| 5 | E | 330 |
| 6 | F | 349 |
| 7 | F# | 370 |
| 8 | G | 392 |
| 9 | G# | 415 |
| 10 | A | 440 |
| 11 | A# | 466 |
| 12 | B | 494 |

FIG. 1

| Scale Degree | Note | Frequency |
|---|---|---|
| 1 | C | 262 |
| 2 | C1/2# | 269 |
| 3 | C# | 277 |
| 4 | C3/2# | 286 |
| 5 | D | 294 |
| 6 | D1/2# | 302 |
| 7 | D# | 311 |
| 8 | D3/2# | 320 |
| 9 | E | 330 |
| 10 | E1/2# | 340 |
| 11 | F | 349 |
| 12 | F1/2# | 360 |
| 13 | F# | 370 |
| 14 | F3/2# | 381 |
| 15 | G | 392 |
| 16 | G1/2# | 404 |
| 17 | G# | 415 |
| 18 | G3/2# | 428 |
| 19 | A | 440 |
| 20 | A1/2# | 453 |
| 21 | A# | 466 |
| 22 | A3/2# | 480 |
| 23 | B | 494 |
| 24 | B1/2# | 509 |

FIG. 2

| Scale Degree | Note | Frequency |
|---|---|---|
| 1 | C | 262 |
| 2 | D | 294 |
| 3 | D3/2# | 320 |
| 4 | F | 349 |
| 5 | G | 392 |
| 6 | A | 440 |
| 7 | B1/2# | 509 |

FIG. 3

| Status Byte | | Data Bytes | Description |
|---|---|---|---|
| Hex | Binary | | |
| **Channel Messages** | | | |
| Channel Voice Messages | | | |
| 8n[5]H | 1000nnnn | 1- Not number (0 - 127)<br>2- Note velocity | Note Off |
| 9nH | 1001nnnn | 1- Note number (0 - 127)<br>2- Note velocity (0 - 127) | Note On<br>0 = Note Off |
| AnH | 1010nnnn | 1- Note number (0 - 127)<br>2- Pressure value | Polyphonic aftertouch |
| BnH | 1011nnnn | 1- Control number (0 - 120)<br>2- Control value | Control Change |
| | | Channel Mode Messages | |
| | | 1- Control number (121 - 127)<br>2- Control value (0 or 127, work as switches) | Select Channel Mode |
| CnH | 1100nnnn | 1- Program number | Program change |
| DnH | 1101nnnn | 1- Pressure value | Channel Aftertouch |
| EnH | 1110nnnn | 1- LSB value<br>2- MSB value | Pitch bend change |

[5] n = Channel Number.

FIG. 7

| Status Byte | | Data Bytes | Description |
|---|---|---|---|
| Hex | Binary | | |
| **System Messages** | | | |
| System Exclusive Messages | | | |
| F0H | 11110000 | Can be of any length | MIDI System Exclusive. Reserved by each manufacturer for use with their own products. |
| System Common Messages | | | |
| F1H | 11110001 | 1- Message type and value | MIDI Time Code Quarter Frame |
| F2H | 11110010 | 1- Lower half of the number<br>2- Higher half of the number | Song Position Pointer |
| F3H | 11110011 | 1- Song number | Song Select |
| F4H | 11110100 | None | Undefined |
| F5H | 11110101 | None | Undefined |
| F6H | 11110110 | None | Tune Request |
| F7H | 11110111 | None | End Of System Exclusive (EOX) |
| System Real-Time Messages | | | |
| F8H | 11111000 | None | Timing Clock |
| F9H | 11111001 | None | Undefined |
| FAH | 11111010 | None | Start |
| FBH | 111111011 | None | Continue |
| FCH | 11111100 | None | Stop |
| FDH | 11111101 | None | Undefined |
| FEH | 11111110 | None | Active Sensing |
| FFH | 11111111 | None | System Rest |

FIG. 7 (CONT.)

DYNAMIC MICROTUNABLE MIDI INTERFACE PROCESS AND DEVICE

CROSS-REFERENCES TO RELATED APPLICATIONS

This is a non-provisional application claiming the benefit of an application previously filed under 37 C.F.R. §1.53 (c). The previous application had identity of inventorship, was filed on Feb. 7, 2002, and was assigned Application Ser. No. 60/358,688.

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of electronic music equipment. More specifically, the invention comprises a device and method for microtuning a component employing the standard MIDI interface so that it can receive and transmit frequency steps other than those employed in the conventional twelve-step scales found in traditional Western music. The invention makes use of parameters already available within the MIDI interface standard.

2. Description of the Related Art

Music is created and enjoyed by virtually every culture. The nature of the music deemed pleasing by one particular culture, however, is highly subjective. Different people perceive pitch variations in different ways. Only the perception of the octave interval is culturally independent.

The octave interval is described by a simple mathematical function. Beginning with a given tone having a given frequency, the next higher octave will be found by doubling that frequency. As an example, the note designated as A over Middle C is generally tuned to a frequency of 440 Hz. The next higher A therefore has a frequency of 880 Hz. People of all cultures perceive the A note at 880 Hz to be the same note as the A note at 440 Hz, although all people will also recognize the difference in pitch. Thus, the perception of the octave is not dependent on culture. All cultures perceive the octave interval in the same way.

The same cannot be said of how the octave interval is divided. Each octave can be subdivided in an infinite variety of ways. These subdivisions generally are referred to as "steps" or "half steps." FIG. 1 illustrates one octave division which is the standard in Western (meaning Western European cultures and their descendants) music. Using Middle C as a starting point (262 Hz), most readers will recall that the Western octave is divided into twelve "half steps" (sometimes called semitones). The size of the half step between frequency f2 and frequency f1 is governed by the relationship:

$$f_2=f_1/0.9439$$

Thus, the C sharp (C#) immediately above the starting A has a frequency of 277 Hz. Those skilled in the art will appreciate that the starting point for the octave is relatively insignificant in comparison to the step size between the frequencies selected. As an example, the A above middle C is often used as a point of reference for tuning. While this note has traditionally been tuned to 440 Hz, some modern orchestras tune the starting A to 444 Hz. The frequency intervals remain governed by the equation presented above, however. As a result, although the pitch of all notes played by the orchestra has been shifted slightly higher, the audience will hear the musical scales as the same.

It may surprise some readers to learn that the frequency intervals set forth in FIG. 1 only became standard within the past several centuries, even in Western music. Johann Sebastian Bach, the famous German composer, worked to standardize orchestral tunings. Prior to his creation and promotion of the standard intervals, many different tunings were employed. These were largely unique to certain instruments. Bach's standardized tuning is now referred to as the "Equal Temperament."

The prior variety in tunings is not surprising when one considers the variety of devices used to make music. The guitar serves as a good example. Those skilled in the art will know that a guitar is a musical machine that operates via varying the vibrating length of strings maintained under constant tension. The length variation is produced by the musician's fingers pressing a string down against a fingerboard. Most modern guitars have transverse wires embedded in the fingerboard, called "frets." The function of the fret is to provide a hard metal edge which defines the vibrating length of string at a fixed position corresponding to the appropriate frequency intervals. Thus, the frets must be physically placed so as to produce frequency intervals like those set forth in FIG. 1.

The proper positioning of the frets requires an understanding of the physics describing vibrating strings. This understanding was quite beyond the knowledge of medieval instrument makers. The frequency intervals produced by a particular instrument were often dependent upon the maker's variations in construction. Thus, even in Western music, frequency intervals like those disclosed in FIG. 1 are a relatively modern creation.

The human perception of frequency intervals appears to be purely subjective. The terms "consonance" and "dissonance" are often used to describe this perception, with "consonance" describing a perception where two notes make a harmonious combination and "dissonance" describing a perception where two notes seem to clash. These perceptions are apparently cultural, as combinations which sound pleasing to Western ears are often displeasing to those raised in other cultures.

One good example is Middle Eastern music. Music composed by persons of Middle Eastern descent is not limited to the frequency intervals disclosed in FIG. 1. In particular, much smaller frequency intervals are needed for certain compositions. FIG. 2 discloses an octave divided into 24 frequency intervals. A typical Arabic musical scale—known as Rast—is disclosed in FIG. 3.

Obviously, musical compositions created using the frequency intervals disclosed in FIGS. 2 and 3 cannot be played on a Western instrument such as the piano or guitar. Thus, the frequency intervals which were standardized for Western music are not compatible with Middle Eastern music. The same can be said for Oriental music and music of many other cultures.

The MIDI Standard

The music industry has traditionally been driven by analog technology. Analog circuitry has long been used for recording, signal processing, and amplification. Digital technology came into use during the early 1980's. During this same period, computer technology was applied to many signal processing applications, such as oscilloscopes and spectrum analyzers. There was a general desire to apply computer technology to musical instruments and recording equipment. In order to do this, however, an interface standard was needed.

In 1982, a meeting of scientists and engineers from a number of companies resulted in the creation of the Musical Instrument Digital Interface, commonly referred to as "MIDI." The MIDI interface standard allows the analog electrical output of a musical instrument—such as a keyboard or electric guitar—to be fed into a computer as digital data. These data are then manipulated using software and typically fed out to amplification equipment which generates sound for the enjoyment of listeners. The computer software can perform all the functions typically done independently by noise gates, phase shifters, distortion effects, and the like. The computer can also do much more, however. As an example, the computer can receive input tone data from a keyboard and digitally manipulate it to produce the sound of a trumpet. The computer can, in fact, generate an entire orchestra of sounds using the single input from a keyboard.

Those skilled in the art will realize that the term "computer" in this context encompasses a broad range of devices. A personal computer having a MIDI card can be employed. There are also dedicated rack-mounted MIDI computers that are used to receive input from a dozen or more instruments and which can control an entire sound system.

The MIDI system encompasses both hardware and a data transmission protocol. FIG. 4 illustrates some standard MIDI hardware, showing both analog and MIDI transmissions. FIG. 5 illustrates MIDI connection hardware. Three MIDI ports (connections) are provided for the user: MIDI IN, MIDI OUT, and MIDI THRU. MIDI IN receives MIDI data from an external component. MIDI out transmits data created within the component. MIDI THRU (which is optional) allows for a straight pass-through of MIDI data with no alterations.

The way in which the MIDI interface transmits signals is more important to the present invention than the hardware involved. MIDI uses a serial interface with transmissions occurring asynchronously. Data is transmitted in ten bit bytes, with a start bit, eight data bits, and a stop bit. When the data is to be used, the start and stop bits are discarded, leaving the eight data bits. These are then passed on to the microprocessor within each MIDI device for processing.

Those skilled in the art will know that an 8 bit packet of data can produce no more than 256 unique words (2 raised to the 8th power). Given that the MIDI standard must ideally transmit a great deal of information about a musical sequence, including pitch, tremolo, attack, sustain, and the like, 256 words are clearly insufficient. To overcome this problem, the first byte in a stream of data is designated as a Status Byte. The Status Byte informs the receiving device what kind of message is coming next. The actual data following the Status Byte are called Data Bytes. The first bit in a Status Byte is set to "1" (1nnnnnnn). The first bit in a Data Byte is set to 0 (0nnnnnnn). This election reduces the number of information carrying bits in each byte to only 7. However, the use of the Status Byte allows the interface to identify 256 different types of data. Therefore, each MIDI message contains a Status Byte instructing the receiving device what to do and one or more Data Bytes telling it how to perform the specified function.

The Status Byte performs the additional function of designating a channel for a particular signal. Those skilled in the art will know that musical recording often involves the blending of many different separate channels. Often, each instrument in an ensemble will be fed into a mixer on its own channel. When a MIDI interface is used, all this data is transmitted on a single bus. Thus, it is important to know which data belongs on which channel. To accomplish this goal, the Status Byte is divided into two halves. The lower four bits designate the channel number (providing 16 possible channels). The second, third, and fourth bit of the Status Byte actually designate the desired function (recalling that the first bit is used to designate the byte as a Status Byte). The use of these three bits allow eight separate instructions. Thus, the Status Byte allows eight different instructions to be given on one or more of sixteen different channels. The eight different types of Status Bytes and the subsequent attached Data Bytes create two basic types of MIDI messages: Channel messages and System messages. Channel messages are sent to one particular device. System messages, in contrast, are directed to all devices on the MIDI network.

Channel messages, in turn, are subdivided into two categories. Channel Voice messages specify or modify a musical note, or group of notes. Channel Mode messages are used to configure the receiver.

System messages are subdivided into three types: System Common messages, System Real-Time messages, and System Exclusive messages. System Common messages specify data that are of interest to all devices in the system (such as overall volume). System Real-Time messages are used to handle timing related events (such as percussion sequences). System Exclusive messages are reserved for each manufacturer's use with its own products. As such, System Exclusive messages are not standardized. FIG. 6 illustrates this categorization of messages.

It is important for the reader to understand the details of some particular Status Bytes (out of the eight possible types). The first type of Status Byte is 1000nnnn (where "n" denotes a variable of either 1 or 0). Recalling what was explained previously, the first bit is set to "1" to indicate the fact that this is a Status Byte. The next three bits are all set to "0", indicating that this particular Status Byte carries the instruction "Note Off." The last four bits specify which channel the command is directed to. Thus, the transmission of 10000000, would decode as a "Note Off" command on the first of the sixteen channels. Data Bytes would then follow, instructing which note to turn off, etc.

The second Status Byte is 1001nnnn, which carries the instruction "Note On." The third Status Byte is 1010nnnn, known as "Key Aftertouch." Although this function is not commonly used, its intent was to convey data regarding the pressure remaining on the key of a keyboard after it has been pressed. It is capable of measuring both vertical and lateral variations in pressure on the key. This function is needed since some keyboards allow variations produced both by the musician's downward pressure on the key and lateral pressure (typically used to create vibrato).

The fourth Status Byte is 1011nnnn, which carries the instruction "Control Change." It is always followed by two Data Bytes The first Data Byte specifies the type of control to be changed, and the second Data Byte specifies the amount of the change. One would expect that 128 different control functions would therefore be allowed (0 through 127 of the 7 bit word comprising the Data Byte). However, controllers 121 through 127 are reserved for Channel Mode messages. Thus, only 0 through 120 are available to designate control functions.

The fifth Status Byte is 1100nnnn, which carries the instruction "Program Change." This message is followed by one Data Byte specify the program number and one Data Byte specifying the channel.

The sixth Status Byte is 1101nnnn, which carries the instruction "Channel Aftertouch." This instruction affects all the notes on a given channel. It could, for example, specify a prolonged sustain ("reverb") for the notes on a particular channel.

The seventh Status Byte is 1110nnnn, which carries the instruction "Pitch Bend." This function allows a note to be pitch shifted up or down in steps which are sufficiently small to escape detection by the human ear. Unfortunately, it normally operates to shift the pitch of every note, rather than just selected notes.

The eighth Status Byte is 1111nnnn, which carries the instruction "System Messages." These messages are used to control all channels on the MIDI system. As a result, the lowest three binary digits are not needed to designate a channel number. They may be used, instead, to carry additional data. Thus, there are sixteen different allowable System Messages.

The message 11110000 is a MIDI Exclusive message. It can be followed by any number of Data Bytes in which the manufacturer ID and model number are specified for a given musical instrument or piece of hardware.

There are some digital messages which will, by their nature, need to be transmitted to all components on the MIDI system. These are called System Common messages. The first System Common message is 11110001, known as "MIDI Time Code Quarter Frame." MIDI time code ("MTC") was introduced in 1987 in order to synchronize timing functions in MIDI to SMPTE devices such as video and audio recorders. Those skilled in the art will realize that prior art analog devices must be synchronized in order to prevent scanning errors (such as when a video image "rolls"). MTC can be transmitted via Full Frame or Quarter Frame messages. A Full Frame message would be too large to send for every SMPTE frame (which might require 60 such frames per second). Thus, MTC Quarter Frame messages are sent in two-byte groups at a constant rate of 120 messages per second. These messages serve the dual purpose of providing a basic timing pulse for the system and providing a 4-bit nibble defining a digit of a specific field of the current SMPTE time code location.

The second System Common message is 11110010, known as "Song Position Pointer." It instructs a sequencer or drum machine which position in time to start the playback from. This position is a count of time (14-bit value) from the beginning of the sequence.

The third System Common message is 11110011, known as "Song Select." One Data Byte is used after this message to specify a sequence or drum pattern number which will commence upon receipt of a real-time start message.

The fourth and fifth System Common messages (11110100 and 11110101) are both undefined. The sixth System Common message is 1110110, called "Tune Request." This message requests that all analog oscillators on the system be retuned to correct for frequency shift errors. Analog synthesizers had a tendency to pitch shift over time, so this retuning was necessary. Now that almost all the synthesizers are digital this command is rarely used.

The seventh System Common message is 11110111, known as "EOX." "EOX" is an acronym standing for End Of eXlusive. This serves as a flag to indicate the end of a MIDI Exclusive message.

The next set of commands is composed of eight System Real-Time messages. The first of these is 11111000, which is the MIDI Clock message. It is sent at the rate of 24 messages per quarter note to synchronize clock-based MIDI systems (such as drum sequences). The Tempo setup at the sending device alters the timing of this message.

The second Real-Time message is 11111001, which is undefined.

The next three Real-Time messages are best understood in conjunction. 1111010 is "Start", 11111011 is "Continue", and 11111100 is "Stop." These three messages control synchronization when MIDI's synchronization functions are used. When the master instrument sends a Start, Continue, or Stop message, all other MIDI devices immediately respond to these commands.

The sixth Real-Time message, 11111101, is undefined.

The seventh Real-Time message is 11111110, known as "Active Sensing." If an instrument is equipped with an Active Sensing device, it should send Active Sensing messages every 300 milliseconds or less, unless it is busy sending other MIDI messages at a higher rater. If the receiver of these messages is also Active Sensing-equipped, it should recognize them and send its own Active Sensing messages back to the other instruments. If an instrument never receives an Active Sensing message, it should operate normally. However, once an instrument receives an Active Sensing message, it will subsequently expect to receive additional such messages at least once every 300 milliseconds. If it does not receive any message during this time period, it assumes that all MIDI cables have been disconnected and will turn all voices off. Thus, this type of message serves an error-sensing function.

The eighth Real-Time message is 11111111, which is System Reset. It instructs all MIDI devices in the system to return to their initialized power-up condition. This command is rarely used, typically being sent only when the system hangs in a loop and ceases functioning.

All System Real-Time messages are single byte messages used to synchronize clock-based MIDI equipment. Since they are real time messages, they can be inserted anywhere in the data stream—even between the Status Byte and Data Bytes of another type of message. These Real-Time messages are given a high priority in the data processing hierarchy in order to maintain synchronization.

FIG. 7 provides a summary of the MIDI messages described in the preceding text.

Optimization techniques are used to reduce the amount of data the MIDI interface needs. One prominent technique is called Running Status. Running Status means that once a Status Byte is received in a MIDI instrument, it will maintain that status. As an example, if a Note On Status Byte is sent, then additional Data Bytes are sent to specify the note and velocity. Using Running Status, additional data is sent specifying more notes—making use of the original Status Byte. A new Status Byte is only sent if a new type of command is needed.

Limitations in the MIDI System

The MIDI interface system is now recognized to have three significant limitations: (1) Bandwidth limitations; (2) Network Routing Limitations; and (3) Music representation limitations.

The bandwidth limitation problem results from the fact that the MIDI transmission rate is fixed at 31250 bits per second. It thus takes 312 microseconds to transmit one 10-bit word. This transmission rate was considered fast when it was created in the early 1980's. However, those skilled in the art will know that data transmission rates are now much higher.

The bandwidth limitation means that complex musical textures are often chopped or truncated. Musicians refer to this phenomenon as "MIDI choke." It often produces a jerkiness or sluggishness in the sound. The proposed invention does not really address this bandwidth concern. However, it is important to be aware of the bandwidth concern, because any proposed solution to other MIDI limitations must not aggravate the bandwidth issue.

The second MIDI limitation involves network routing. MIDI data transmission is unidirectional; i.e., each communication direction requires its own cable. Any reasonably complex MIDI system therefore winds up with a web of cables. Those skilled in the art will contrast this scenario with the simplicity of parallel interface cables used in computing devices. Modern networking technology could have solved these interconnection problems much more elegantly. This was not anticipated at the time the MIDI standard was created. Local Area Network (LAN) to MIDI converters are now often used to work around this problem.

The proposed invention does not directly address these networking problems. Again, however, it is important to understand that any new technique that is to live within the MIDI protocol must not aggravate the existing problems.

The proposed invention does address MIDI's third recognized limitation—its limited ability to represent different musical forms. When MIDI was developed, it was strongly influenced by Western music. Thus, it is designed to represent the twelve notes in an equal-temperament scale. It is severely limited in its ability to move outside of this scale.

The two main weaknesses are MIDI's inability to control timbre and its inability to create certain pitches. MIDI has no control over timbre. This results in the artificial sound quality of many MIDI compositions, wherein every note has the same timbre and envelope. A second limitation is the lack of control over the type of sound to be produced by different synthesizers interpreting the same MIDI message.

MIDI's pitch limitations are the primary focus of the present invention. By giving the MIDI system the ability to create notes which do not lie on the traditional Western scales, the inventor allows the MIDI standard to be used by musicians in non-Western cultures.

MIDI's Pitch Limitations

A MIDI Data Byte, as explained previously, is only 7 bits long. It can thus only carry 128 possible discrete values for any variable, including pitch. Having 128 possible pitch values is sufficient for Western music played on a keyboard. It is also sufficient for "well-tempered music" played on the traditional Western scale in which the octave is divided into twelve equal semitones. It is insufficient, however, for modern Western music—which seeks to deviate from the conventional octaval division. It is also insufficient to represent the music of many non-Western cultures.

Prior Art Approaches to MIDI's Pitch Limitations

Since the weakness of pitch representation is inherent in the MIDI standard, one approach has been to try and change or supplement the standard. This approach was taken by Robert Rich and Carter Scholz in the creation of their MIDI Tuning Standard (MTS). The MTS was later added to the MIDI standard. It can create a pitch resolution (minimum step size) of 0.0061 octaves. The MTS solution had the following theoretical advantages: (1) The 0.0061 resolution is sufficient for most researchers and musicians; (2) It is quite flexible in that it can retune a whole instrument, part of an instrument range, or even a single selected note; (3) The retuning can be done on the fly without interrupting other MIDI functions; and (4) It is standardized.

Unfortunately, although the MTS solution was added to the MIDI standard, it had no support from industry. In fact, no instrument that the inventor knows of presently makes use of the MTS. Thus, while it is a theoretical solution, it has not gained any industry acceptance.

The second approach to the pitch limitation involves the use of a tuning box. A tuning box is a piece of hardware which is attached externally to the sound synthesizer. The tuning box is programmed to retune the sound synthesizer. It uses the MIDI System Exclusive messages described previously (which the reader will recall are not standardized). The tuning box includes buttons for the user to press. When a button is pressed, the tuning box sends a System Exclusive message to retune the desired note. The tuning box connects to the musical instrument just like any other MIDI device—through the device's MIDI IN port.

Additional features can be added to the tuning box. For example, some tuning boxes are equipped with memory chips to store preset frequently used scales so that the entire scale can be selected by pressing a single recall button. Many tuning boxes also incorporate LCD displays augmenting the use of the memory functions.

The tuning box is relatively inexpensive and easy to use. It can be plugged into a synthesizer through the standard MIDI ports and can retune the desired notes through the press of a single button. Unfortunately, however, the tuning box approach is entirely dependent on the System Exclusive messages. The reader will recall that these messages are specific to each MIDI device and manufacturer (they are not standardized). Thus, tuning boxes will often only work with the one instrument they were designed for. At best, they will only work with instruments from the same manufacturer.

Another disadvantage inherent in using System Exclusive messages is the fact that they are of a very large size. They were actually designed for bulk dumps, as in when an instrument is first connected it can transmit its stored settings to other components on the system. These messages were not really intended for real time transmissions. As a result, the use of tuning boxes often slows the MIDI system because of the size of the System Exclusive messages employed.

A third traditional approach to solving MIDI's pitch limitations involves the use of Pitch Bending. Pitch Bending is a MIDI function which allows a note to be "bent" (pitch shifted up or down), in real time. Pitch Bend MIDI messages cause all the notes on that channel to be shifted up or down a specified amount. The pitch bend is specified as a 14-bit number, using two 7-bit bytes. This results in 16,384 pitch steps being available. The availability of 16,384 steps can produce pitch bends which are completely smooth to the human ear (even though they are carried out in discrete steps). It should also be noted that Pitch Bend commands are standard within the MIDI interface.

However, the use of Pitch Bend messages have two main disadvantages. First, they are Channel Voice messages (as explained previously). This means that they alter the pitch of every note on that channel, not just a few selected notes. Computer software can be used to work around this problem by assigning the notes to be retuned to a separate channel. Since there are only 16 channels to work with, though, losing a channel for every retuned note or set of notes is a cumbersome solution.

The second problem with using Pitch Bend messages is the fact that the range of pitch bending is set on the receiving instrument. Thus, different instruments may interpret and implement the same Pitch Bend message differently. This process can be cured by setting the pitch bending range on the instruments in question. However, more pitch setting is needed prior to playback, or live performance. The result is that the pitch bending approach cannot truly be described as standardized.

BRIEF SUMMARY OF THE INVENTION

The proposed invention makes use of the Polyphonic Aftertouch (also known as "Key Aftertouch") messages available in the basic MIDI standard. Polyphonic Aftertouch is used to represent the horizontal and vertical pressure variations a musician places on a key after it has been depressed. Typically, horizontal variation in pressure conveys the musician's desire to bend the pitch of the note (vibrato). Hence, if a MIDI device is made with horizontal Polyphonic Aftertouch, this feature can be used to retune selected notes.

The proposed invention implements notes which do not lie on the traditional Western semitone scale using the following method: First, a standard note lying on the Western scale is played. Then, a Polyphonic Aftertouch signal is immediately sent to shift the pitch of the standard note to transform it into a non-standard note. The Polyphonic Aftertouch message follows immediately behind the Note On message and pitch value creating the standard note. Thus, the standard note only sounds for about 960 microseconds. The shortest temporal resolution of the human ear is approximately 2–3 milliseconds. As a result, the human ear does not hear the first standard note, since it does not sound for a sufficient length of time. The human ear only perceives the pitch shifted note.

This approach has the following advantages:

1. It uses functionality already in the MIDI standard, so that the new features can be communicated to all MIDI devices;
2. It is implemented by short messages, so it does not degrade the overall efficiency of the system;
3. It does not require the cooperation of the different instrument manufacturers; and
4. It is capable of retuning notes individually and selectively.

BRIEF DESCRIPTION OF THE SEVERAL VIEWS OF THE DRAWINGS

FIG. 1 is a table showing the traditional Western division of the octave.

FIG. 2 is a table showing an octaval division using 24 steps.

FIG. 3 is a table describing the Arabic Rast musical scale.

FIG. 7 is a table, showing a summary of MIDI messages.

DETAILED DESCRIPTION OF THE INVENTION

Figure 4:
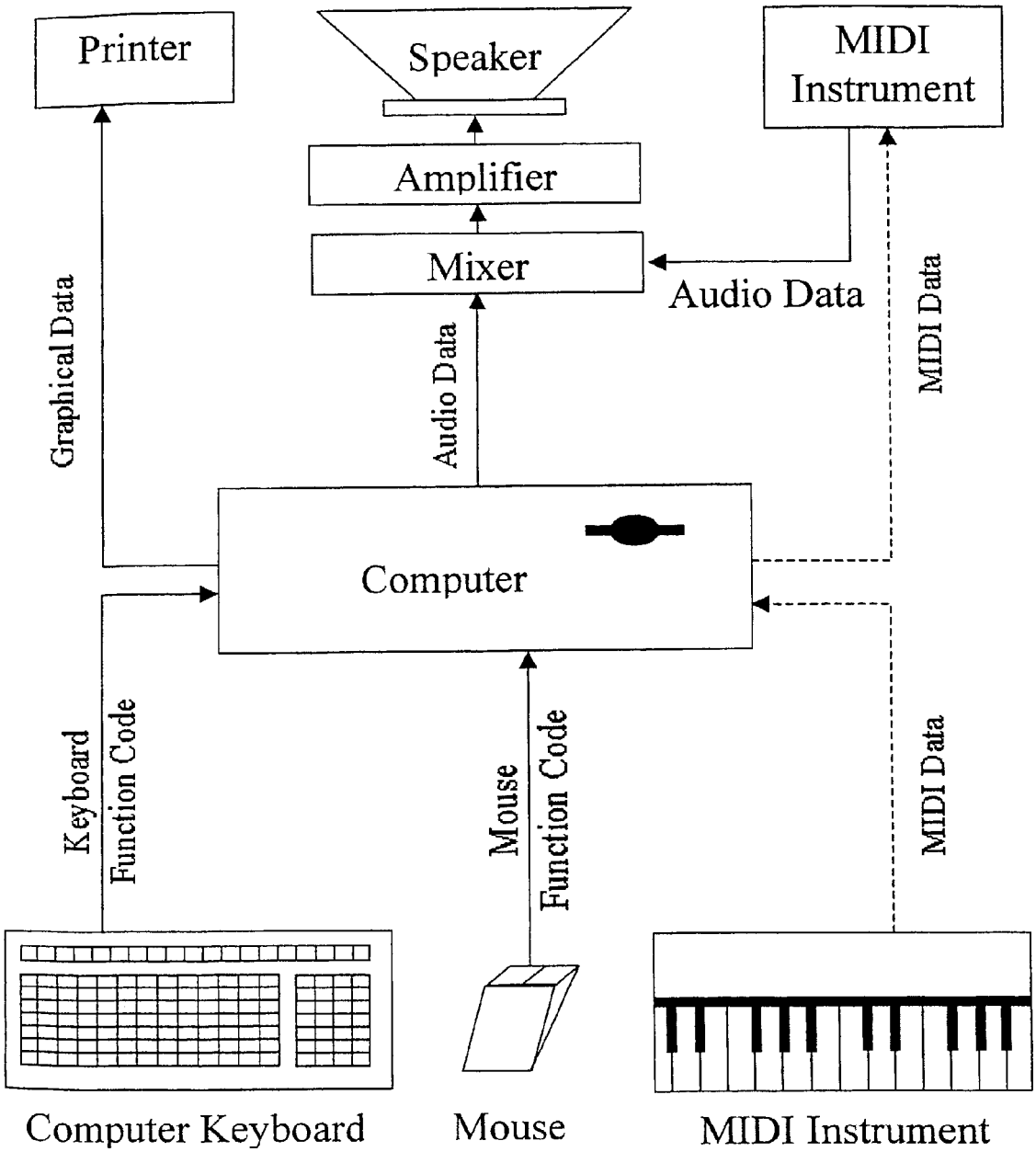
FIG. 4 is a schematic view, showing a representative MIDI ensemble.
Figure 5:
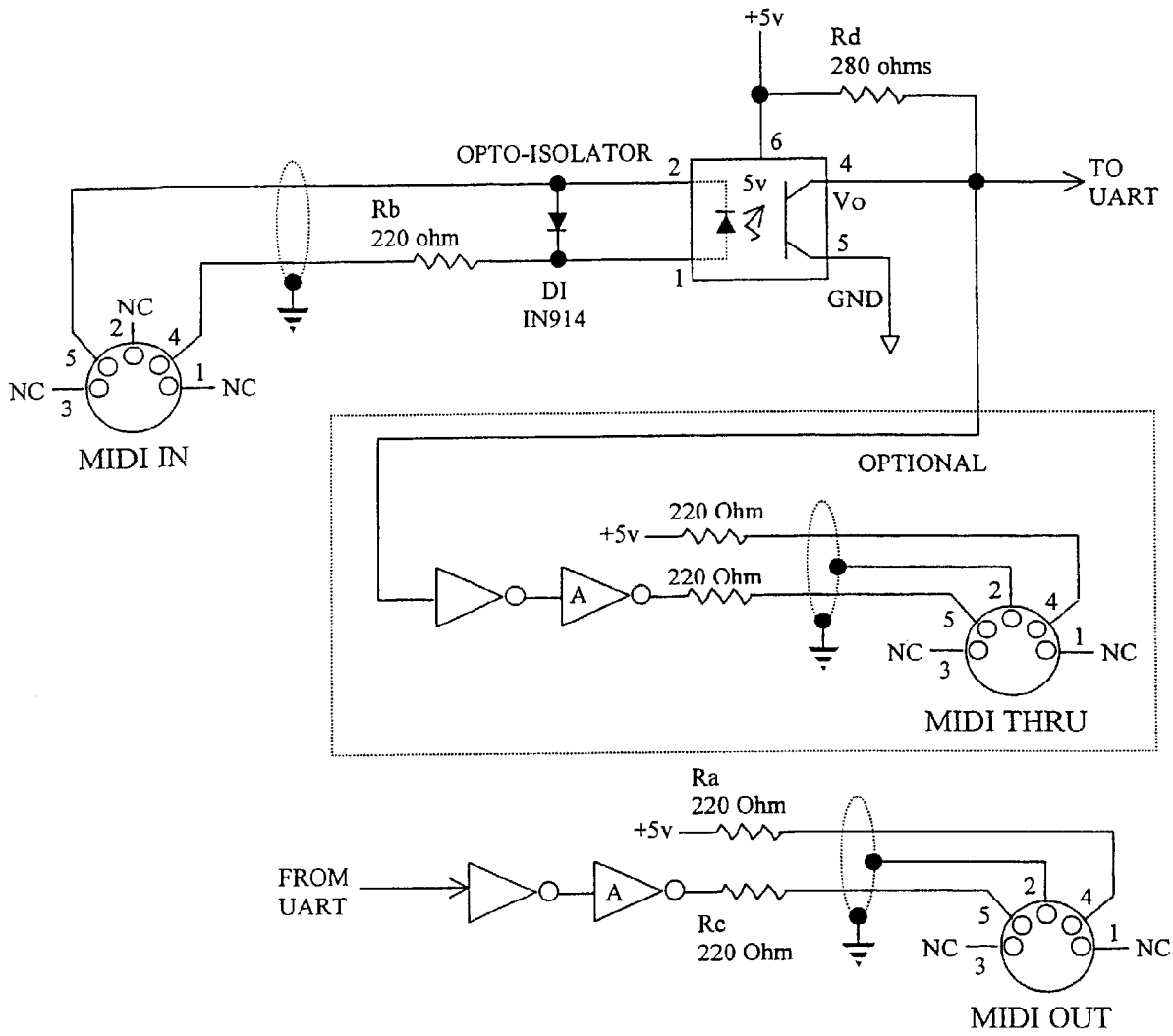
FIG. 5 is a schematic view, showing the standard MIDI data ports.
Figure 6:
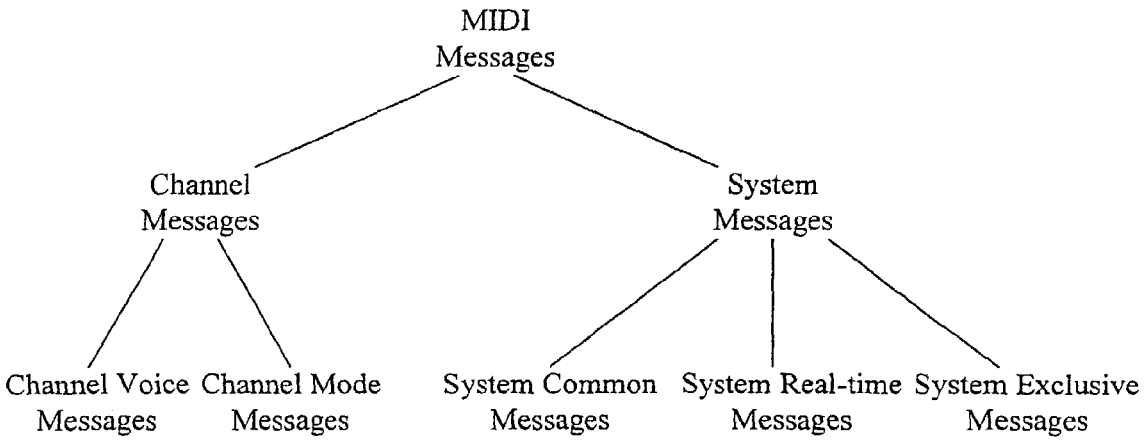
FIG. 6 is a schematic view, showing the classification of MIDI messages.

As mentioned previously, Polyphonic Aftertouch is used to represent the horizontal and vertical variations in pressure placed on a keyboard key after it is depressed. A variation in vertical pressure typically reflects the musician's desire to vary the volume. A variation in the horizontal pressure typically reflects the musician's desire to vary the pitch. Thus, the MIDI standard includes the fact that Polyphonic Aftertouch can be used to vary the pitch of a note.

Polyphonic Aftertouch messages are standard in MIDI. Most MIDI devices incorporate the feature. Polyphonic Aftertouch also works on individual notes, thus enabling selective retuning. Finally, Polyphonic Aftertouch messages are short, meaning that they can be transmitted in real time without sacrificing system performance.

A typical Polyphonic Aftertouch message is composed of three bytes: one Status Byte, followed by two Data Bytes. The First Data Byte specifies the note and the Second Data Byte specifies the pressure value. Polyphonic Aftertouch messages have been traditionally used to create effects such as vibrato, necessitating the transmission of a stream of such messages. The inventor proposes to use these messages instead for retuning notes. Only a single message is needed per note.

Aftertouch messages are transmitted after a note is struck. Thus, if they are to be used for retuning, they will be transmitted after the conventionally tuned note has sounded. This is not a practical limitation, however. The three bytes in a Polyphonic Aftertouch message should be transmitted in 960 microseconds—slightly less than one millisecond. The temporal resolution of the human ear—meaning the shortest interval over which it can discriminate two signals—is approximately 2–3 milliseconds. Thus, if the MIDI system sounds a first note, but then shifts the pitch on that note 960 microseconds later and then sustains the shifted pitch, the human ear will only hear the shifted pitch. In effect, the ear "smears" the two pitches together, with the result that only the retuned note is perceived.

The reader will recall that only a single Data Byte is available to provide the information on the pitch change. Thus, only 128 values are available for this pitch change. The smallest musical division which is presently recognized is 1/100th of a semitone. This division is generally referred to as a cent. It represents a pitch change which is imperceptible to the human ear. Using the available 128 values in the single Data Byte, it is possible to divide the interval between two semitones into 128 steps. This division is actually smaller than is needed. Thus, the 128 values are sufficient.

In practice, computer software would be used to generate the required Polyphonic Aftertouch messages. As one example, again using the Arabic Rast scale, the E flat over middle C would have to be retuned to E ½ flat. Thus, when the musician strikes the E flat over middle C on a keyboard, the conventional MIDI transmission for the note E flat would be sent. Immediately thereafter, the Polyphonic Aftertouch Status Byte would be sent. After that, a Polyphonic Aftertouch Data Byte would be sent instructing a pitch shift on the E flat note to E ½ flat.

The following lines of code, in the C programming language, employing hexadecimal notation, would be used to implement a conventional note in MIDI (including comments to explain each line):

```
midi.bData[0]=0x90; // note on
midi.bData[1]=0x3c; // note number (specifies which note
  to turn on)
midi.bData[2]=0x7f; // note velocity
midi.bData[3]=0x00;
midiOutShortMsg (hmo, midi.dwData);
```

The function "midiOutShortMsg" directs that the data be transmitted out to the specified MIDI output device—in this case "hmo." The sequence presented will sound the note middle C.

As described previously, a retuned (i.e., non-standard) MIDI note must be created using two messages. Such a sequence could be implemented as follows:

```
midi.bData[0]=0x90; // note on
midi.bData[1]=0x3c; // note number (specifies which note
  to turn on)
midi.bData[2]=0x7f; // note velocity
midi.bData[3]=0x00;
midiOutShortMsg (hmo, midi.dwData);
midi.bData[0]=0xa0; // polyphonic aftertouch
midi.bData[1]=0x3c; // note number (specifies which note
  to pitch shift)
midi.bData[2]=0x40; // pressure value (specifies amount
  of pitch shift)
midi.bData[3]=0x00;
midiOutShortMsg (hmo, midi.dwData);
```

This sequence again directs the output device to sound a middle C, but then it directs the device to shift the pitch immediately to a quarter tone sharper than middle C. Experimentation using a keyboard as the input instrument and actual MIDI hardware has established that the use of the Polyphonic Aftertouch functions as described does not significantly degrade the performance of the system. It has also established that the human ear does not discern two notes for the second code sequence given above. The listener only perceives the shifted pitch, even though the unshifted pitch sounds very briefly.

It is true that the Polyphonic Aftertouch function cannot be used for its originally intended purpose when employed as the inventor proposes. However, as explained previously, Polyphonic Aftertouch is very seldom used. The MIDI standard contains a conventional Vibrato function, which is used instead of the features available in Polyphonic Aftertouch. The loss of the conventional Polyphonic Aftertouch function is therefore a minor issue.

There are several approaches to utilizing the technique created by the inventor. The first would be to create a universal tuning box (a piece of hardware, as described previously). This device would function with any MIDI instrument having the Polyphonic Aftertouch capability, regardless of the manufacturer. It could be implemented in many different ways. One way would be to have embedded memory functions that allow the user to retune selected notes to create desired scales.

The use of the Polyphonic Aftertouch function could also be embedded directly into existing MIDI instruments. As one example, a keyboard manufacturer could add the function in its own MIDI software. Through user selection (via a button or other conventional means), the keyboard output would then be retuned to the Arabic Rast scale or other desired scales. As a second example, the technique could be embedded in existing software written for musical notation, sequencing, and editing.

It is important to realize that, although the Arabic Rast scale has been used for illustrations, the technique could be applied to virtually any desired octaval division. The inventor has created a prototype dividing the octave into 24 quarter tones—using 24 keys of a keyboard to span an octave instead of the usual twelve. By changing the software, it would be equally possible to use an entire 88 key keyboard to cover a single octave (breaking the octave into 88 steps). Clever use of the 128 discrete values for the pitch shift allows a virtually infinite number of pitch shifts to be employed.

Although the previous descriptions contain significant detail the y should not be viewed as limiting the scope of the invention but rather as providing illustrations of the preferred embodiments. Thus, the scope of the invention should be defined by the following claims, rather than by the specific examples.

Having described my invention, I claim:

1. In a musical system employing a standard MIDI interface including a plurality of MIDI devices, a process allowing a user to selectively retune notes on one or more of said plurality of MIDI devices in order to create notes which do not lie on the equal temperament scale using standard MIDI commands, comprising:

a. providing a MIDI interface;

b. providing a first MIDI device connected to said MIDI interface;

c. generating a note on said first MIDI device which lies on said equal temperament scale;

d. providing a second MIDI device connected to said MIDI interface;

e. transmitting said note generated on said first MIDI device from said first MIDI device to said MIDI interface and from thence to said second MIDI device;

f. less than two milliseconds after transmitting said note, transmitting a standard MIDI polyphonic aftertouch signal from said first MIDI device through said MIDI interface to said second MIDI device, commanding said second MIDI device to shift the pitch of said note to form a second note which does not lie on said equal temperament scale, so that said user only perceives said second note.

2. A process as recited in claim 1, wherein said standard MIDI polyphonic afterotuch signal is created by a tuning box which is separate from said first MIDI device but connected thereto.

3. A process as recited in claim 1, wherein said polyphonic after touch signal is created by said first MIDI device.

4. In a musical system employing a standard MIDI interface including a plurality of MIDI devices, a process allowing a user to selectively retune notes on one or more of said plurality of MIDI devices in order to create notes which do not lie on the equal temperament scale using standard MIDI commands, comprising:

a. providing a MIDI interface;

b. providing a first MIDI device connected to said MIDI interface;

c. transmitting a note on signal from said first MIDI device to said MIDI interface and from thence to said second MIDI device;

d. transmitting a first note number signal specifying a first note to be played, wherein said first note lies on said equal temperament scale, from said first MIDI device to said MIDI interface and from thence to said second MIDI device;

e. transmitting a note velocity signal, from said first MIDI device to said MIDI interface and from thence to said second MIDI device;

f. less than two milliseconds after transmitting said note on signal, transmitting a polyphonic aftertouch signal from said first MIDI device to said MIDI interface and from thence to said second MIDI device;

g. immediately after transmitting said polyphonic aftertouch signal, transmitting a second note number signal corresponding to said first note from said first MIDI device to said MIDI interface and from thence to said second MIDI device; and h. immediately after transmitting said second note number signal, transmitting a pressure value signal from said first MIDI device to said MIDI interface and from thence to said second MIDI device commanding said second MIDI device to shift the pitch of said first note to create a second note which does not lie on said equal temperament scale, so that said user only perceives said second note.

5. A process as recited in claim 4, wherein said standard MIDI polyphonic afterotuch signal is created by a tuning box which is separate from said first MIDI device but connected thereto.

6. A process as recited in claim 4, wherein said polyphonic after touch signal is created by said first MIDI device.

* * * * *